US007034238B2

(12) United States Patent
Uleski et al.

(10) Patent No.: US 7,034,238 B2
(45) Date of Patent: Apr. 25, 2006

(54) WIRELESS KEY FOB FOR VEHICLES

(75) Inventors: Michael A. Uleski, Roseville, MI (US); Yi Luo, Superior, MI (US)

(73) Assignee: Lear Corporation, Southfield, MI (US)

( * ) Notice: Subject to any disclaimer, the term of this patent is extended or adjusted under 35 U.S.C. 154(b) by 86 days.

(21) Appl. No.: 10/940,571

(22) Filed: Sep. 14, 2004

(65) Prior Publication Data

US 2006/0054484 A1 Mar. 16, 2006

(51) Int. Cl.
*H01H 3/40* (2006.01)

(52) U.S. Cl. ..... 200/500; 200/341

(58) Field of Classification Search ..... 200/314, 200/1 B, 5 A, 341–345, 512–517, 5 R, 13; 206/37, 37.1, 39
See application file for complete search history.

(56) References Cited

U.S. PATENT DOCUMENTS

| | | | | |
|---|---|---|---|---|
| 5,175,873 | A | 12/1992 | Goldenberg et al. | |
| 5,819,568 | A * | 10/1998 | Christie et al. | 70/395 |
| 5,828,316 | A | 10/1998 | DiCroce | |
| 5,945,906 | A | 8/1999 | Onuma | |
| 6,016,676 | A * | 1/2000 | McConnell | 70/408 |
| 6,545,629 | B1 * | 4/2003 | Johnson et al. | 341/176 |
| 6,669,017 | B1 * | 12/2003 | Linihan | 206/305 |
| 6,694,258 | B1 * | 2/2004 | Johnson et al. | 701/213 |
| 6,696,983 | B1 | 2/2004 | Tang et al. | |
| 6,713,895 | B1 * | 3/2004 | Krapfl | 307/10.1 |
| 2001/0038328 | A1 | 11/2001 | King et al. | |
| 2002/0008610 | A1 | 1/2002 | Peterson | |
| 2002/0175096 | A1 | 11/2002 | Linihan | |
| 2003/0117261 | A1 | 6/2003 | Gunsch | |
| 2003/0134600 | A1 | 7/2003 | Picone et al. | |
| 2003/0197640 | A9 | 10/2003 | Johnson et al. | |
| 2003/0231550 | A1 | 12/2003 | Macfarlane | |
| 2004/0085251 | A1 | 5/2004 | Shimura | |
| 2004/0099430 | A1 | 5/2004 | Scudder | |
| 2005/0215286 | A1 * | 9/2005 | Brass et al. | 455/557 |
| 2005/0222720 | A1 * | 10/2005 | Flick | 701/2 |
| 2005/0248436 | A1 * | 11/2005 | Hohmann et al. | 340/5.72 |

FOREIGN PATENT DOCUMENTS

| | | |
|---|---|---|
| GB | 2396730 | 6/2004 |

* cited by examiner

*Primary Examiner*—Michael Friedhofer
*Assistant Examiner*—Lisa Klaus
(74) *Attorney, Agent, or Firm*—MacMillan, Sobanski & Todd, LLC

(57) ABSTRACT

A key fob assembly comprises an electronic circuit comprising a substrate carrying a plurality of switching elements and a display element. A rear casing member having a first outer rim and receives the electronic circuit. A front casing member has a second outer rim, a plurality of button apertures, and a display window. The button apertures are substantially aligned with the plurality of switching elements and the display window is substantially aligned with the display element. A lens is contained within the display window providing a protective layer over the display element. An elastomeric seal member is provided having an outer periphery captured between the first and second outer rims and having a display aperture defined by an edge wherein the edge is captured between the display element and at least one of the front casing member and the lens. The elastomeric seal member includes a plurality of pedestals aligned with respective ones of the button apertures. A plurality of substantially rigid button caps are each cohered to a respective one of the pedestals and project into a respective one of the button apertures, whereby a button cap can be depressed toward the substrate to actuate a respective one of the switching elements.

18 Claims, 5 Drawing Sheets

WIRELESS KEY FOB FOR VEHICLES

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to remote keyless entry systems for motor vehicles, and, more specifically, to a high performance key fob with an integrated display and configured to provide environmental protection and impact resistance.

Wireless remote control units for use with motor vehicles are well known in the art. One typical type of system includes a remote keyless entry system for remotely locking and unlocking doors and performing other functions. The wireless communication system comprises a vehicle-mounted receiver and a portable key fob carried by the user. The key fob contains various push buttons for initiating the transmission of particular remote control commands (e.g., lock doors, unlock doors, unlock trunk, or initiate panic alarm).

Key fobs are being increasing deployed for applications using two-way communication between the key fob and the vehicle. Two-way communication is utilized, for example, in car locator systems wherein the two-way exchange of signals between the key fob and the receiver assist the holder of the key fob in finding their vehicle in a parking lot. In order to convey information relayed from the vehicle transmitter to the user, a visual or graphic display may be included in the key fob. The display may also include a clock display and a battery charge indicator, for example.

Key fobs are becoming increasingly sophisticated as more and more features are remotely-controlled and as additional types of information are conveyed to the key fob user. The use of sensitive electronic components in the key fobs intensifies the need for environmental protection (e.g., from moisture intrusion) and shock protection (e.g., from banging or dropping). For ease of carrying, a small size for the key fob needs to be achieved. Even though switch packaging space in the key fob is limited, it is desirable to maintain a satisfying tactile feel of the buttons and to minimize the possibility of inadvertent button activations. Even while achieving all the foregoing objects, the key fob needs to be economically mass-produced.

SUMMARY OF THE INVENTION

The present invention has the advantages of sealing a display and other electronic components within a key fob using an impact absorbing seal while maintaining a small package size and low cost. A high quality tactile feel of pushbutton switches is achieved and inadvertent button activations are minimized.

In one aspect of the invention, a key fob assembly comprises an electronic circuit comprising a substrate carrying a plurality of switching elements and a display element. A rear casing member has a first outer rim and receives the electronic circuit. A front casing member has a second outer rim, a plurality of button apertures, and a display window. The button apertures are substantially aligned with the plurality of switching elements and the display window is substantially aligned with the display element. A lens is contained within the display window providing a protective layer over the display element. An elastomeric seal member is provided having an outer periphery captured between the first and second outer rims and having a display aperture defined by an edge wherein the edge is captured between the display element and at least one of the front casing member and the lens. The elastomeric seal member includes a plurality of pedestals aligned with respective ones of the button apertures. A plurality of substantially rigid button caps are each cohered to a respective one of the pedestals and project into a respective one of the button apertures, whereby a button cap can be depressed toward the substrate to actuate a respective one of the switching elements.

DETAILED DESCRIPTION OF PREFERRED EMBODIMENTS

Figure 1:
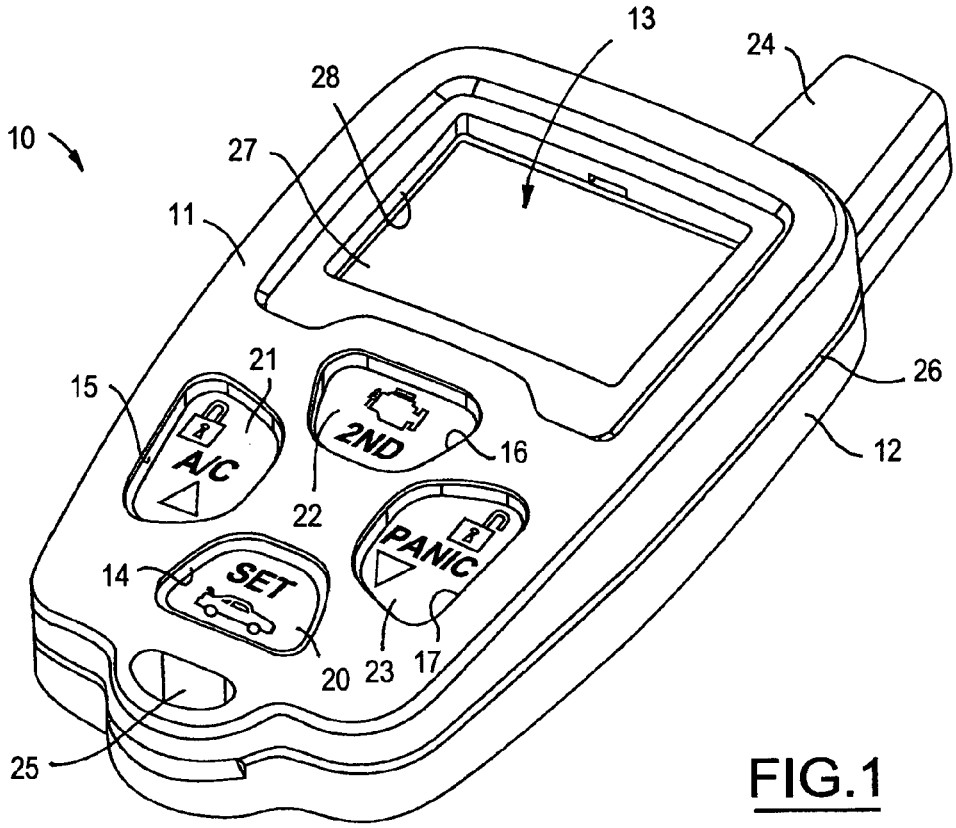
FIG. 1 is a perspective view of the key fob of the present invention.

Referring now to FIG. 1, the key fob 10 includes a front casing member 11 and a rear casing member 12 enclosing key fob electronics including a display element 13. Front casing member 11 includes a plurality of button apertures 14–17 for receiving button caps 20–23, respectively. The button caps may include respective graphic symbols printed thereon to identify various commands to be transmitted to the vehicle or for adjusting functions within key fob 10 (e.g., setting a clock). Front and rear casing members 11 and 12 cooperatively form an antenna chamber 24 at one end thereof and a key ring passage 25 at the other end. An elastomeric seal member 26 has an outer periphery captured between the outer rims of front and rear casing members 11 and 12. Preferably, elastomeric seal member 26 does not extend into antenna chamber 24 or key ring passage 25. A lens 27 is insert molded into the front casing member 11 within a display window 28 in order to protect the display element 13.

Figure 2:
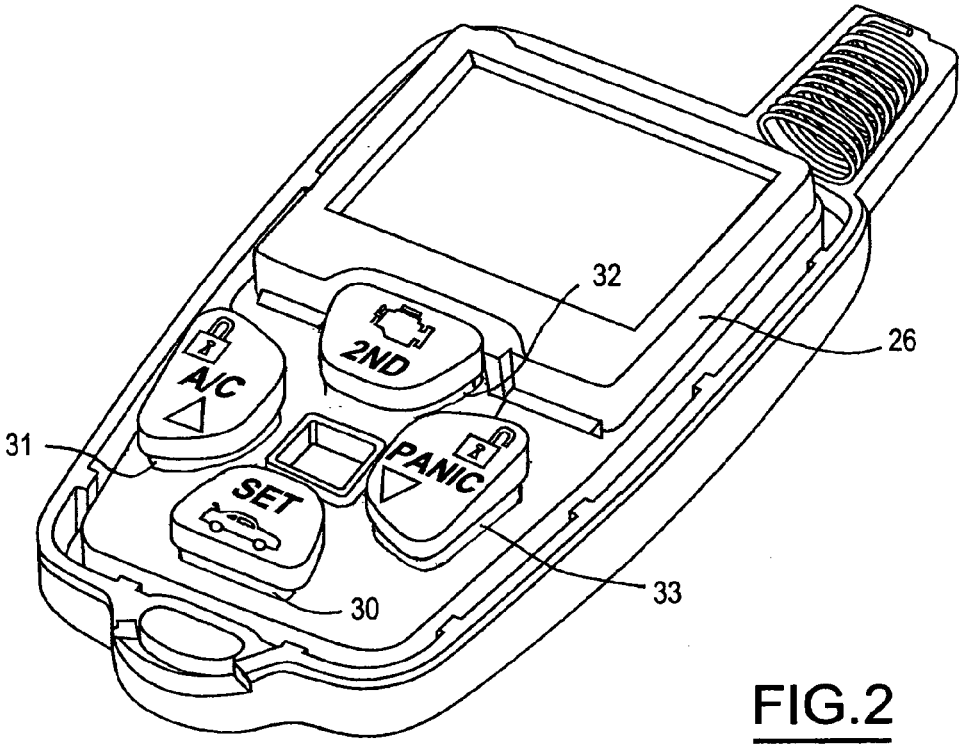
FIG. 2 is a perspective view of the key fob with the front casing member removed.
Figure 3:
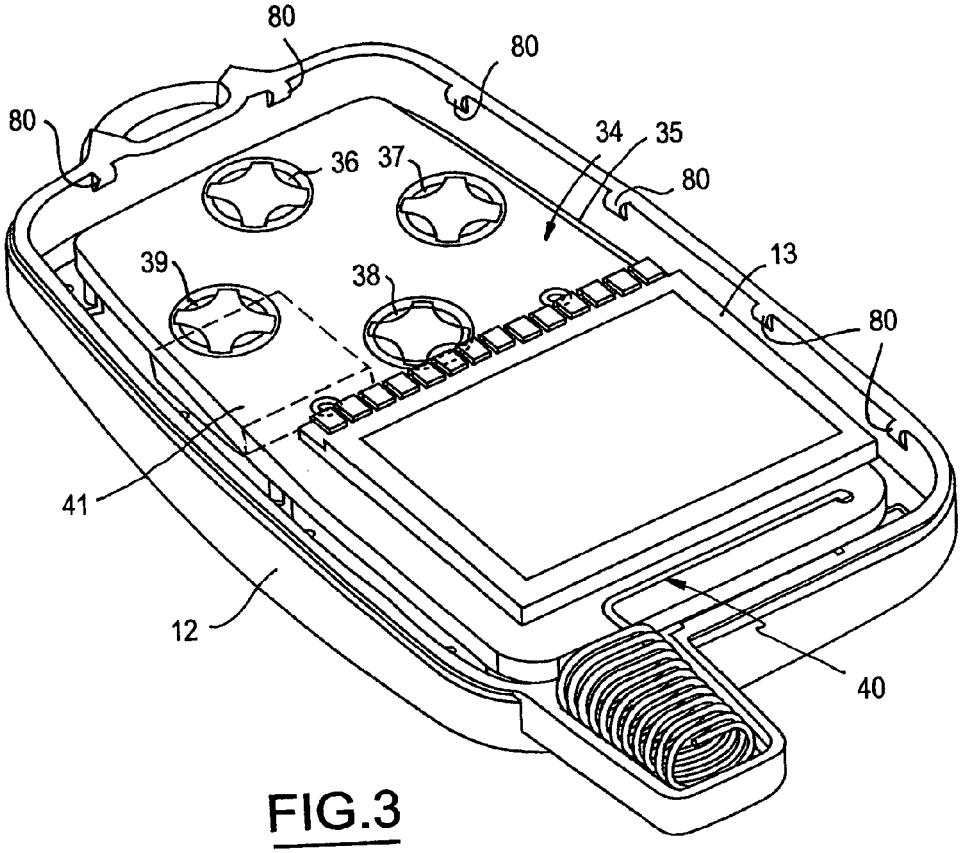
FIG. 3 is a perspective view of the key fob with the elastomeric seal member removed.

FIG. 2 shows key fob 10 with front casing member 11 and its integral lens 27 removed to reveal elastomeric seal member 26 in greater detail. Elastomeric seal member 26 includes a plurality of pedestals 30–33 for receiving button caps 20–23, respectively. As shown in FIG. 3 (in which elastomeric seal member 26 is removed), rear casing member 12 receives an electronic circuit 34 comprising a circuit board 35 for supporting a plurality of switching elements 36–39 which are aligned with pedestals 30–33, respectively. Also connected to printed circuit board 35 are display element 13 and an antenna 40. An integrated circuit 41 is mounted to the bottom side of printed circuit board 34 and may comprise a remote keyless entry (RKE) transceiver fabricated as an application specific integrated circuit (ASIC). Rear casing member 12 preferably includes a receptacle and/or circuit board alignment posts for interfacing with circuit board 34 to retain it in a predetermined position.

Figure 4:
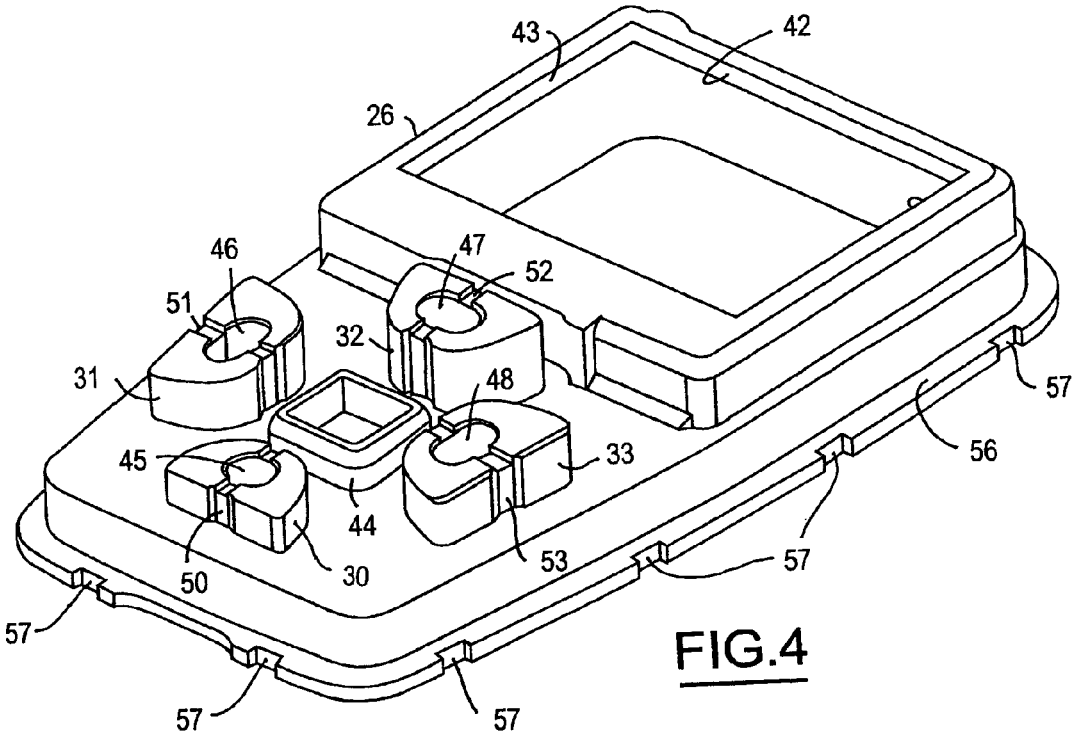
FIG. 4 is a perspective view of the top side of the elastomeric seal member.
Figure 5:
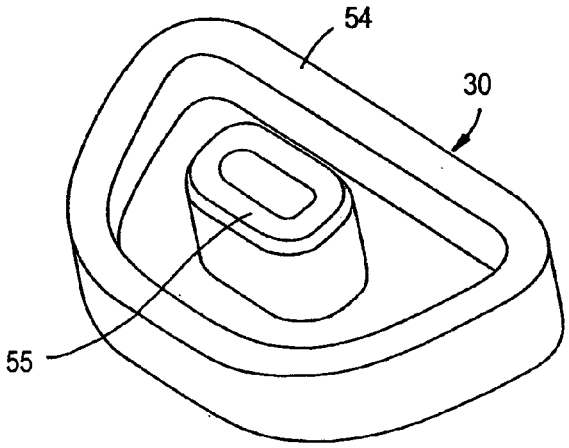
FIG. 5 is a perspective view of the bottom side of the button cap.

FIG. 4 shows elastomeric seal member 26 in greater detail. It is preferably formed of compression-molded silicone. A display aperture 42 has a beveled edge 43 at its periphery, wherein display aperture 42 is aligned with display element 13. Pedestals 30–33 project upward from elastomeric seal member 26 surrounding a central projection 44. Pedestals 30–33 each includes a respective central cavity 45–48 and respective air relief channels 50–53 across their top surfaces and lateral side surfaces. Each pedestal preferably has a uniquely keyed shape and each respective button cap has a matching shape for installing only on a particular matching pedestal. As shown in the bottom perspective view of FIG. 5, button cap 30 includes an outer sleeve 54 and an inner stem 55. Since each button cap has printed graphics for identifying functions to be accessed by depressing the corresponding button, uniquely keyed apertures and matching buttons insure that errors of assembling a button on the wrong pedestal are avoided. The unique keying is obtained by providing different cross-sectional dimensions of the pedestals and/or different sizes or shapes of the central cavities and matching inner stems, for example. The button caps are preferably fabricated from a rigid plastic material and are cemented to the pedestals by a suitable adhesive. Air relief channels 50–53 are provided to equalize pressure when assembling the button caps and to provide a residual channel for excess adhesive to accumulate when bonding the button caps in place. The increased surface conformity provided by the outer sleeves and the inner stems increases the bonding surface area for maximizing bonding strength between the button caps and the pedestals. As shown in FIG. 4, elastomeric seal member 26 includes a flange 56 around its outer periphery having a plurality of notches 57.

Figure 6:
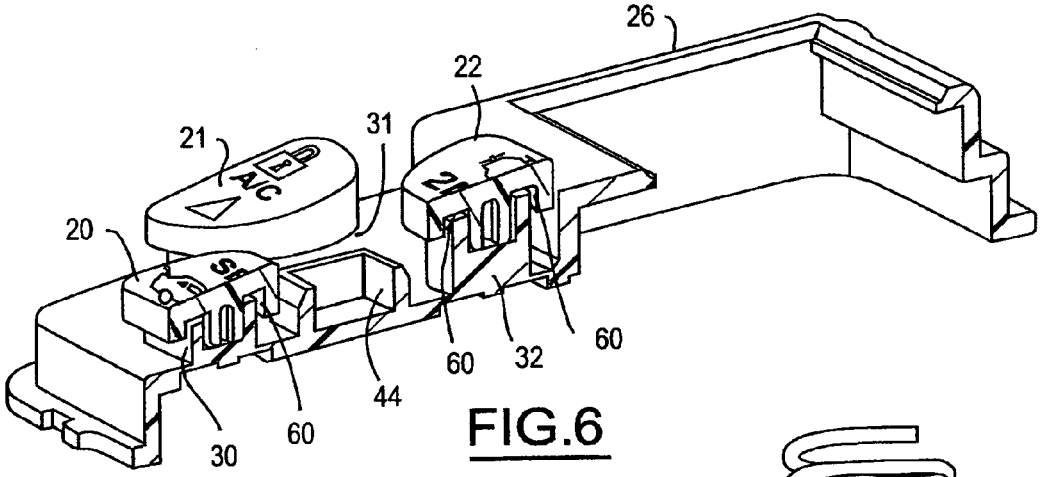
FIG. 6 is a cross-sectional perspective view of the elastomeric seal member and button caps.
Figure 7:
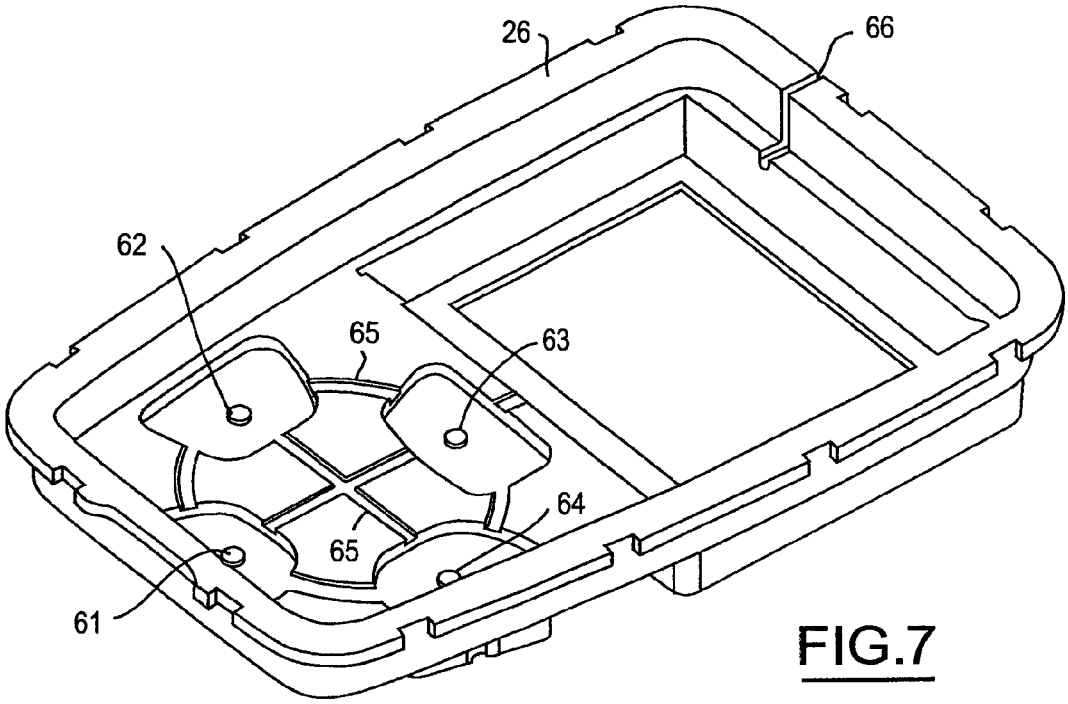
FIG. 7 is a perspective view of the bottom side of the elastomeric seal member.

FIG. 6 shows a vertical cross-section along a mid-centerline of elastomeric seal member 26 and button caps 20 and 22. An adhesive 60 is applied between button caps 20 and 22 and pedestals 30 and 32 so that the button caps strongly cohere to the pedestals. FIG. 7 shows the bottom (i.e., the electronic circuit-facing) side of elastomeric seal member 26. The bottom sides of pedestals 30–33 include actuator posts 61–64, respectively. Posts 61–64 are aligned with switching elements 36–39 and assist in actuating the respective switching elements when a user manually presses the corresponding button cap. A network of air relief channels 65 is provided in the underside of elastomeric seal member 26 interconnecting the second sides of the pedestals to prevent back pressure building up upon activation of the button caps. Upon activation, the force applied to a button cap deflects the corresponding pedestal toward the switching elements on the printed circuit board so that the corresponding actuator post triggers the corresponding switching element. When released, spring forces produced by the switching element and the elastomeric seal member restore the button cap and pedestal to their original positions.

Elastomeric seal member 26 includes a slot 66 for receiving the wire conductor of antenna 40. The width of slot 66 is preferably slightly smaller than the diameter of the wire conductor of antenna 40 in order to maintain sealing of the main cavity within key fob 10 containing the electronic circuit board.

Figure 8:
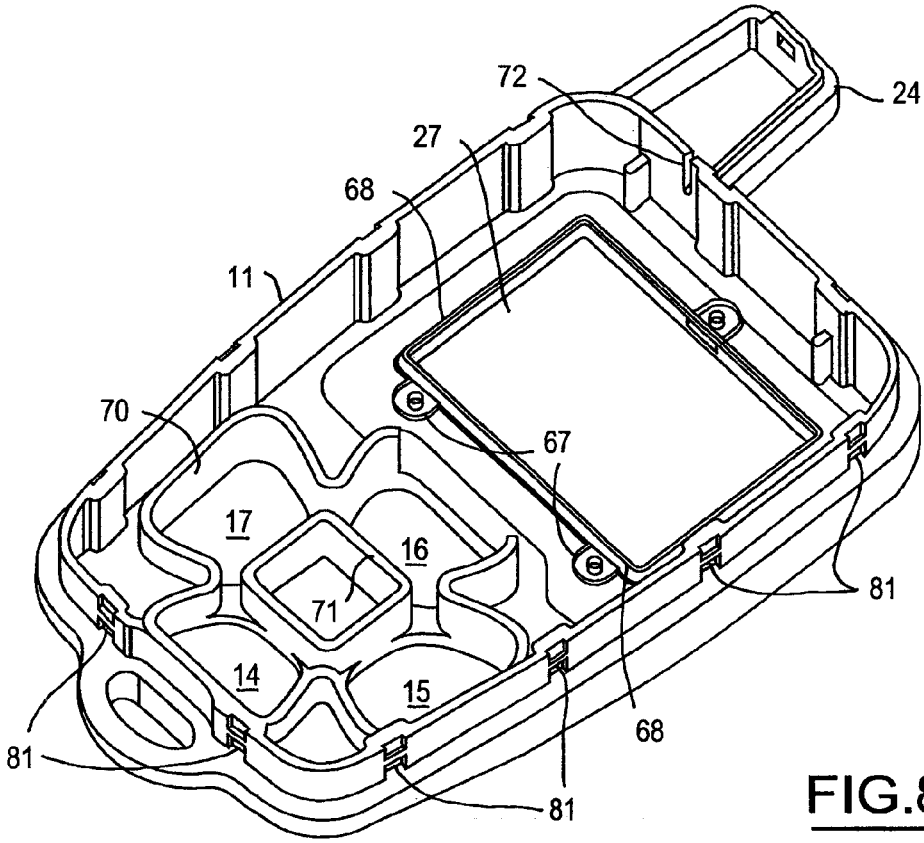
FIG. 8 is a perspective view of the bottom side of the front casing member.

FIG. 8 shows a bottom view of front casing member 11. Lens 27 has the shape of a flat panel including a plurality of tabs 67. A prefabricated clear plastic molded lens is preferably injection molded together with front casing member 11 in order to obtain a self-sealing integrated structure for protecting the display element. Front casing member 11 includes a chamfered rim adjacent lens 27 for matching with beveled edge 43 of elastomeric seal member 26. The peripheries of button apertures 14–17 are defined in part by a plurality of guide walls 70. The button caps and pedestals are received within guide walls 70 and move longitudinally within the guide walls. Preferably, the height of the pedestals together with the height of the button caps results in the button caps being recessed within guide walls 70 (i.e., positioned below the outer surface of front casing member 11) when they are not being actuated. The recessed button caps are less likely to be accidentally or inadvertently triggered.

Front casing member 11 also includes a guide way 71 for receiving projection 44 of elastomeric seal member 26 to further maintain the alignment of the pedestals and button caps. A slot 72 is provided in the outer rim of front casing member 11 in order to receive the wire conductor of antenna 40 passing into antenna chamber 24.

Figure 9:
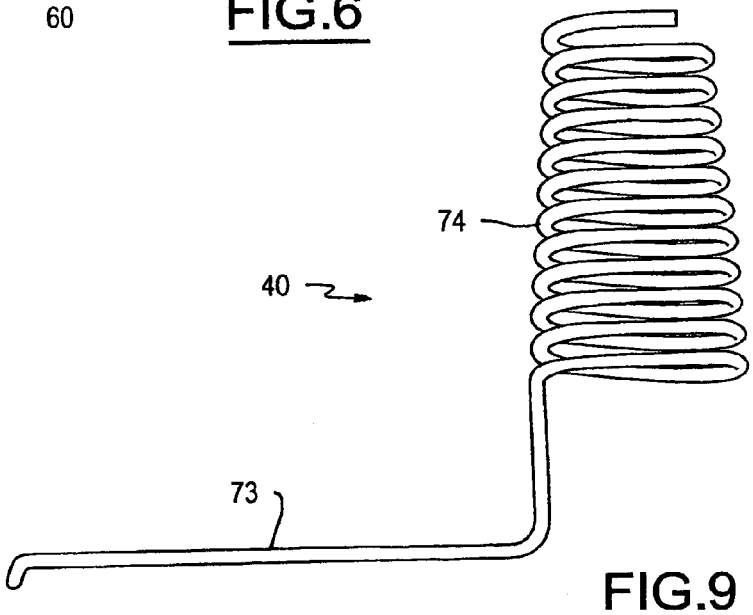
FIG. 9 is a side view of the antenna formed as a tapered helix.

As shown in FIG. 9, antenna 40 is formed by winding a conductive wire into a predetermined shape with an antenna feed line 73 merging into a tapered helix portion 74. Each loop of the tapered helix preferably has a quasi-rectangular profile with radiused corners. Moving from antenna feed 73 to the end of tapered helix portion 74, the lengths of each turn of the tapered helix portion 74 are gradually reduced in size. Because of the flattened shape obtained by using quasi-rectangular helix, antenna 40 can easily fit in the narrow profile of antenna chamber 24 while maintaining a long antenna length for improved transmission and reception.

To retain the key fob together as one unit, snap tabs are provided on the rear and/or front casing members which pass through notches 57 on elastomeric seal member 26. For example, a plurality of tabs 80 on rear casing member 12 engage detents 81 on front casing member 11 (shown in FIG. 8). Consequently, front and rear casing members 11 and 12 can be separated in order to change a battery (shown as battery 95 in FIG. 11).

In view of the foregoing structures, the elastomeric seal member fits closely around the display element (e.g., an LCD graphic screen) and around the periphery of the printed circuit board to create a sealed cavity preventing environmental contaminants or water from entering the cavity containing the electronic components of the key fob. In addition, the entrapment of the LCD and the circuit board by the elastomeric seal member provides a shock absorber to protect these components from impact if the key fob is dropped.

The beveled edge around the perimeter of the display aperture and the elastomeric seal member allows the chamfered edge of the display window rim to fit into the seal and engage the chamfered surface. Consequently, the width of the sealing surface around the display window is increased, thereby improving the seal. Thus, any moisture or other contaminants penetrating behind the front casing member are blocked from reaching the electronic circuits. Also, the beveled surface creates a narrower width (e.g., 0.5 mm) of the elastomeric seal showing through the display window.

Figure 10:
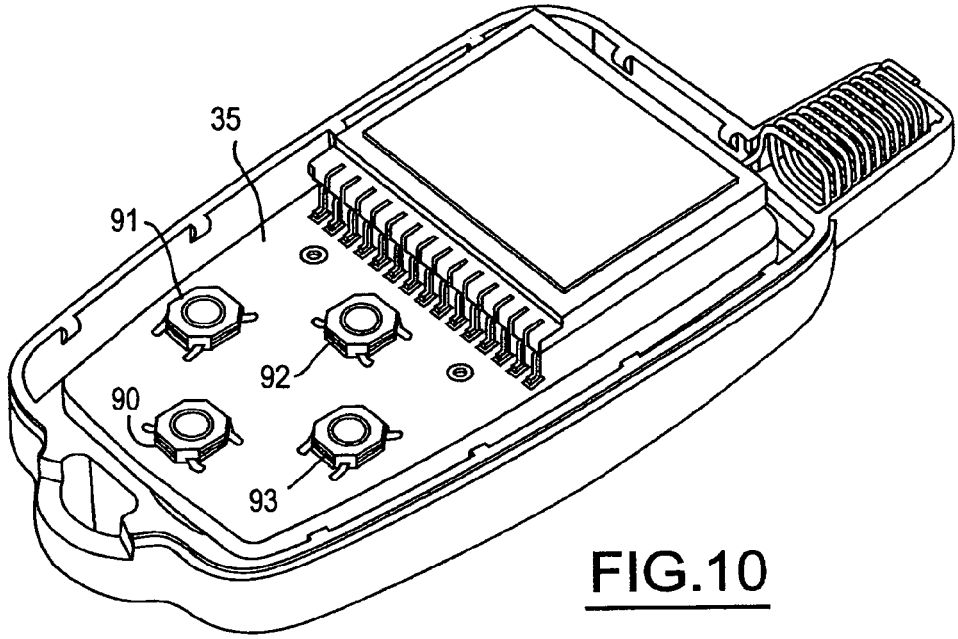
FIG. 10 is a perspective view of the rear casing member and circuit board of an alternative embodiment.
Figure 11:
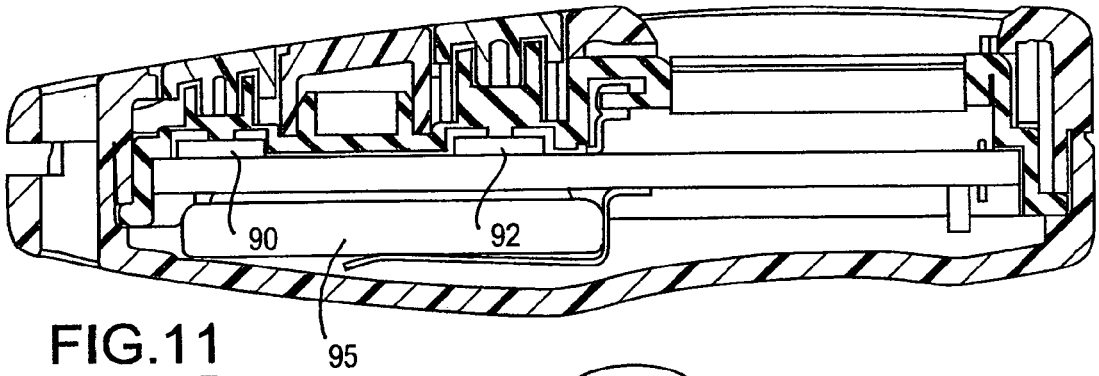
FIG. 11 is a cross-sectional view of the alternative embodiment of FIG. 10.
Figure 12:
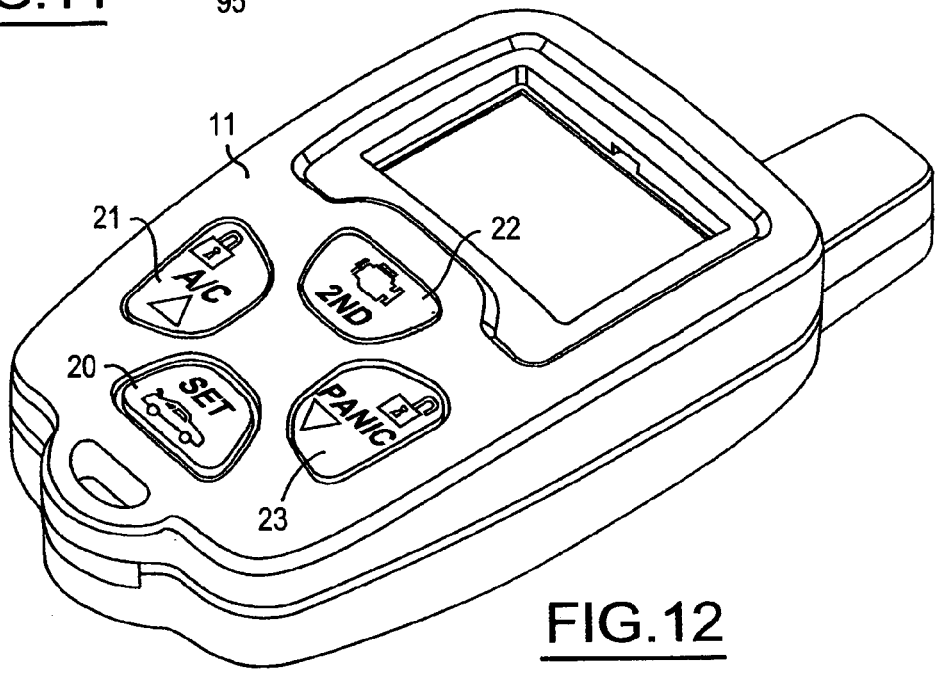
FIG. 12 is a front perspective view of the assembled unit of FIG. 11.

An alternative embodiment of the invention is shown in FIGS. 10–12 wherein button caps 20–23 are mounted flush with the outer surface of front casing member 11 when in their relaxed, unactuated condition. In order to provide a stiffer button action that better resists inadvertent actuations, tact switches 90–93 are used on circuit board 35 instead of dome switches. Tact switches (such as an SKQG Series Tact switch having an actuation force of 3.43 Newtons from ALPS Electric Company, Ltd.) are miniature switches with a click-type tactile feedback and which require a somewhat greater force to activate than a dome switch. Therefore, the height of button caps 20–23 and pedestals 30–33 can result in a flush arrangement with the outer case without creating false activation problems.

What is claimed is:

1. A key fob assembly comprising:

an electronic circuit comprising a substrate carrying a plurality of switching elements and a display element;

a rear casing member having a first outer rim and receiving said electronic circuit therein;

a front casing member having a second outer rim, a plurality of button apertures, and a display window, wherein said button apertures are substantially aligned with said plurality of switching elements, and wherein said display window is substantially aligned with said display element;

a lens contained within said display window providing a protective layer over said display element;

an elastomeric seal member having an outer periphery captured between said first and second outer rims and having a display aperture defined by an edge wherein said edge is captured between said display element and at least one of said front casing member and said lens, wherein said elastomeric seal member includes a plurality of pedestals aligned with respective ones of said button apertures; and a plurality of substantially rigid button caps each cohered to a respective one of said pedestals and projecting into a respective one of said button apertures, whereby a button cap can be depressed toward said substrate to actuate a respective one of said switching elements.

2. The assembly of claim 1 wherein said lens is joined with said front casing member by insert molding.

3. The assembly of claim 1 wherein a first side of each of said pedestals facing said button caps includes a respective air relief channel.

4. The assembly of claim 1 wherein a second side of each of said pedestals facing said electronic circuit includes a respective actuator post for actuating a respective switching element.

5. The assembly of claim 4 wherein said elastomeric seal member includes air relief channels interconnecting said second sides of said pedestals.

6. The assembly of claim 1, wherein each button cap includes a unique graphic appearing thereon, wherein each of said pedestals has a unique keyed shape, and wherein each respective button cap has a matching shape for installing only on a matching pedestal.

7. The assembly of claim 1 wherein said pedestals each include a central cavity, wherein said button caps each include an outer sleeve receiving a respective pedestal, and wherein said button caps each include an inner stem received in a respective central cavity.

8. The assembly of claim 7 further comprising adhesive joining said outer sleeves and said inner stems to respective pedestals.

9. The assembly of claim 1 wherein said front casing member includes a plurality of guide walls defining said button apertures.

10. The assembly of claim 9 wherein said button caps are recessed within respective guide walls.

11. The assembly of claim 9 wherein said button caps are flush with said front casing member.

12. The assembly of claim 1 wherein said elastomeric seal member comprises a flange at said outer periphery.

13. The assembly of claim 12 wherein said front and rear casing members include a plurality of snap tabs for locking said front and rear casing members together and wherein said flange includes a plurality of notches for receiving said snap tabs.

14. The assembly of claim 1 wherein said edge of said display aperture in said elastomeric seal member is beveled and wherein said front casing member includes a matching chamfer around said display window.

15. The assembly of claim 1 further comprising a remote keyless entry antenna coupled to said electronic circuit, wherein said remote keyless entry antenna is comprised of a wire conductor, wherein said front and rear casing members cooperatively define a chamber outside of said first and second outer rims for receiving said antenna, and wherein said flange includes an antenna slot having said wire conductor passing therethrough.

16. The assembly of claim 15 wherein said wire conductor comprises a tapered helix within said chamber.

17. The assembly of claim 16 wherein said helix is substantially rectangular.

18. The assembly of claim 1 wherein said electronic circuit comprises a remote keyless entry transmitter.

* * * * *